US011603855B2

(12) United States Patent
Springer

(10) Patent No.: US 11,603,855 B2
(45) Date of Patent: Mar. 14, 2023

(54) IMPELLER FOR WASTEWATER PUMP

(71) Applicant: KSB SE & Co. KGaA, Frankenthal (DE)

(72) Inventor: Peer Springer, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 0 days.

(21) Appl. No.: 16/635,607

(22) PCT Filed: Jul. 24, 2018

(86) PCT No.: PCT/EP2018/070025
§ 371 (c)(1),
(2) Date: Jan. 31, 2020

(87) PCT Pub. No.: WO2019/025238
PCT Pub. Date: Feb. 7, 2019

(65) Prior Publication Data

US 2020/0240428 A1 Jul. 30, 2020

(30) Foreign Application Priority Data

Aug. 3, 2017 (DE) ..... 10 2017 213 507.7

(51) Int. Cl.
*F04D 29/24* (2006.01)
*F04D 7/04* (2006.01)

(52) U.S. Cl.
CPC ..... *F04D 29/24* (2013.01); *F04D 7/04* (2013.01)

(58) Field of Classification Search
CPC ... F04D 3/02; F04D 7/04; F04D 7/045; F04D 29/181; F04D 29/183; F04D 29/2216;
(Continued)

(56) References Cited

U.S. PATENT DOCUMENTS 3,692,422 A * 9/1972 Girardier ..... F04D 7/045 415/121.1
4,347,035 A 8/1982 Stahle
(Continued)

FOREIGN PATENT DOCUMENTS

DE 28 55 385 B1 11/1979
DE 40 15 331 A1 11/1991
(Continued)

OTHER PUBLICATIONS

International Search Report (PCT/ISA/210) issued in PCT Application No. PCT/EP2018/070025 dated Oct. 16, 2018 with English translation (five (5) pages).
(Continued)

*Primary Examiner* — Woody A Lee, Jr.
*Assistant Examiner* — Brian O Peters
(74) *Attorney, Agent, or Firm* — Crowell & Moring LLP

(57) ABSTRACT

An impeller for centrifugal pumps having at least one blade for delivering solids-containing media has, between a leading edge of the blade and a circumferential direction, an angle α, and between a leading edge of the blade and a meridional direction, an angle β. Depending on the dominant speed, the associated angles α, β are less than 90°, preferably less than 70°, in particular less than 50°.

9 Claims, 8 Drawing Sheets

(58) Field of Classification Search
CPC ..... F04D 29/2227; F04D 29/225; F04D 29/2255; F04D 29/242; F04D 29/245
See application file for complete search history.

(56) References Cited

U.S. PATENT DOCUMENTS

| | | | |
|---|---|---|---|
| 4,540,334 | A | 9/1985 | Stahle |
| 5,348,444 | A | 9/1994 | Metzinger et al. |
| 6,343,909 | B1 | 2/2002 | Springer et al. |
| 2014/0064970 | A1 | 3/2014 | Springer |

FOREIGN PATENT DOCUMENTS

| | | | |
|---|---|---|---|
| DE | 10 2011 007 907 | B3 | 6/2012 |
| EP | 0 114 932 | A1 | 8/1984 |
| EP | 0 874 161 | A1 | 10/1998 |
| WO | WO 2015/000677 | A1 | 1/2015 |

OTHER PUBLICATIONS

German-language Written Opinion (PCT/ISA/237) issued in PCT Application No. PCT/EP2018/070025 dated Oct. 16, 2018 (seven (7) pages).

* cited by examiner

IMPELLER FOR WASTEWATER PUMP

CROSS REFERENCE TO RELATED APPLICATIONS

This application is a continuation of PCT International Application No. PCT/EP2018/070025, filed Jul. 24, 2018, which claims priority under 35 U.S.C. § 119 from German Patent Application No. 10 2017 213 507.7, filed Aug. 3, 2017, the entire disclosures of which are herein expressly incorporated by reference.

BACKGROUND AND SUMMARY OF THE INVENTION

The invention relates to an impeller for centrifugal pumps having at least one blade for conveying solid-containing media.

In centrifugal pumps for conveying solid-containing media, different impellers can be used, for example ducted wheels, non-chokable wheels or single-blade impellers. Ducted wheels are open or closed impellers with a reduced number of blades. 1, 2 or 3 blades in radial or semi-axial impellers have been found to be advantageous.

Non-chokable pumps are also used to convey solid-containing media. Such non-chokable pumps are also referred to as vortex vacuum pumps, the conveying power of which is transmitted from a rotating disk which is fitted with blades, the so-called non-chokable wheel, to the flow medium.

In addition, semi-open impellers are also used in the waste water field.

During the configuration of impellers, the blade form is decisive. In particular, the construction of the inlet edge is highly significant. In waste water pumps, the inlet edge is often covered with fibers which are present in the conveying medium. The fibers are often not transported away from the impeller inlet edges because the respective resistance forces are in equilibrium as a result of the flow resistance at the intake and delivery side. If there is produced an accumulation of fibers at the inlet edges, additional fibers may accumulate so that greater coverings can form. This behavior is promoted particularly when ensuring high ball passages. The ball passage is an important parameter for characterizing the ability to be used of waste water pumps. The ball passage is also referred to as the free, non-constricted impeller passage and describes the greatest permissible diameter of the solid materials in order to ensure a blockage-free passage.

The large flow cross-sections required for an adequate ball passage promote the formation of coverings. In particular in the case of partial loads, for example small volume flows, large flow cross-sections lead to dead water zones which are not flowed through. The dead water zones lead to blockages. Particularly if a large ball passage is required, such coverings of the blades often occur, particularly at the inlet edges.

In single-blade impellers, such coverings result in a higher power being necessary to operate the centrifugal pump. In the case of multiple-blade impellers, the coverings can also result in an asymmetrical flow in the channels. Such asymmetrical flows influence not only the necessary power, but also the conveyed volume flow and the delivery head.

DE 40 15 331 A1 describes an impeller having only one blade. The single-blade wheel produced by a casting method forms, between a front covering disk and a rear shroud, a channel whose cross-section decreases at the inlet of the single-blade wheel toward the outlet. The intake side forms a semicircle which is arranged concentrically with respect to the rotation axis over the first 180° of the rotation angle. The single-blade wheel is configured in such a manner that an occurrence of cavitation erosion is prevented. Unlike single-blade wheels, impellers having a plurality of blades are distinguished by a higher degree of efficiency. However, particular requirements are also placed on such impellers with respect to preventing deposits by solid components. In the case of multi-blade impellers, particular steps have to be taken in order to prevent blockages.

An object of the invention is to provide an impeller for a waste water pump, in which deposits are effectively prevented. In particular, a covering of the inlet edges with fibers is intended to be prevented. The impeller is further intended to ensure a degree of efficiency which is as high as possible in the centrifugal pump used. Furthermore, the occurrence of cavitation erosion is intended to be prevented.

According to the invention $\alpha$ is an angle between an inlet edge of the blade and a peripheral direction and $\beta$ is an angle between an inlet edge of the blade and a meridional direction, wherein in accordance with the dominant speed the associated angle $\alpha$ and/or $\beta$ is configured to be less than 90°, preferably configured to be less than 70°, in particular configured to be less than 50°. The angle $\alpha$ is an angle between an inlet edge of the blade and a peripheral direction. The angle $\beta$ is an angle between an inlet edge of the blade and a meridional direction.

In order to solve the problem of accumulations on the blade, the flow resistance of the fibers is observed for the transport thereof along the inlet edge of the blades. In this case, the speed which is striking the inlet edge is broken down into a normal component and a tangential component. The normal component acts in a pressing manner. The tangential component is responsible for transporting the fibers. During consideration in technical flow terms, both the rotating system and the non-rotating system can be considered. Since the relative speed can be broken down into the components of the peripheral direction and the meridional direction, these directions can also be associated with specific force components.

In a particularly favorable embodiment of the invention, the angle $\beta$ is less than or equal to 45°. Alternatively or additionally, the angle $\alpha$ may also be less than or equal to 45°. The approach according to the invention results in the angle $\beta$ being intended to be configured to be less than or equal to 45° in the inner regions and, in the outer regions, the angle $\alpha$ being intended to be configured to be less than or equal to 45°.

If the dominant regions are separated by the magnitude of the respective speed, for the condition $c_m=u$ there is produced for an axial impeller inlet a limit radius using the throughflow figure $\Phi=c_m/u$ at $R_{grenz}=R_a\times\varphi$. Preferably, $\varphi$ is in the range between 0.3 and 0.6. The speed u is the peripheral speed. The outer radius of the blade is designated $R_a$.

In the recirculation region, the meridional speeds in the inner region increase greatly so that the angle $\beta$ in this direction has increased significance.

The impeller according to the invention allows the centrifugal pump also to be operated in an operating range at small specific speeds and small peripheral speeds. As a result of the transient character, the flow characteristic produced by the impeller according to the invention has a positive effect on the conveying behavior.

As a result of the approach according to the invention of displacing the fiber transport along the inlet edge of the blades as a result of the effect of the tangential components of the respective dominant speed, both in the case of single-blade wheels and in the case of multiple-blade wheels an improvement in the power characteristics of the pump and a better transport without blockages can be ensured. In single-blade wheels, the approach is a known solution in conjunction with a diagonal meridian section.

After transport thereof along the inlet edge, the blades slide over the asymmetric and smoothed hub directly into the blade channel.

In the case of semi-open multiple-blade wheels, the transport is carried out in the direction of the blade tip, where guiding or transport grooves can take over the subsequent processing of the fibers.

In order to be able to use the action of the speed portion which is greater in terms of the value thereof, small angles β, preferably less than 45°, in the range less than the limit radius $R_g$ and small angles α, preferably less than 45°, in the range greater than the limit radius $R_g$ should dominate.

In a particularly advantageous embodiment of the invention, the impeller is constructed to be half-open. Preferably, it is found to be advantageous for the impeller to be configured as a radial wheel. The impeller may have one or more blades. In a particularly advantageous variant of the invention, the impeller has two blades.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
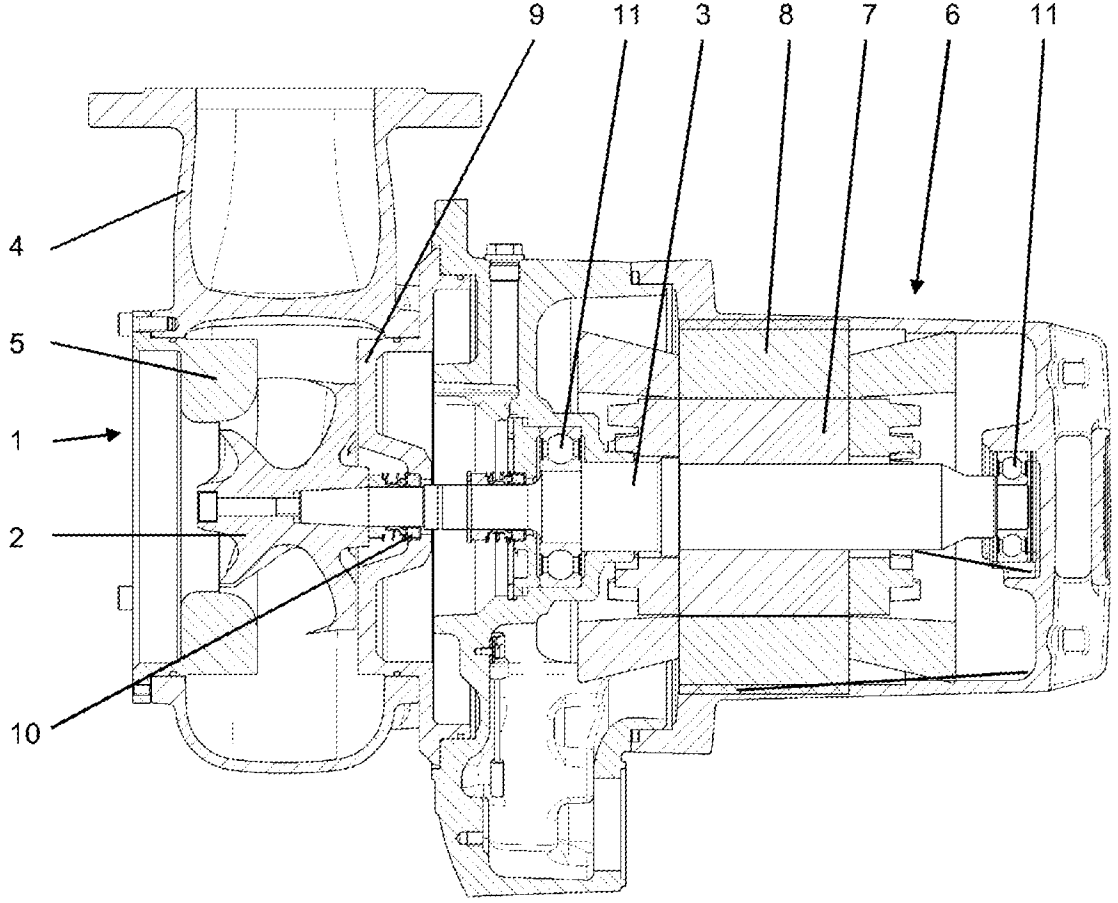
FIG. 1 is an axial section through a waste water pump.

FIG. 1 is a cross-section through a waste water pump. The centrifugal pump illustrated in FIG. 1 is a submersible motor-driven pump. The waste water which is displaced with admixtures is introduced through the intake opening 1 into the pump. The impeller 2 is connected in a rotationally secure manner to a shaft 3, which rotates the impeller 2. The impeller 2 is arranged in a pump housing 4 which in the embodiment is configured as a helical housing.

An insert 5, which is configured in the embodiment as a wear wall or wear ring projects into the intake opening 1 of the pump. The shaft 3 is rotated by a drive 6 which is configured in the embodiment as an electric motor. The drive 6 comprises a rotor 7 and a stator 8.

The pump housing 4 is sealed by a housing cover 9. The housing cover 9 is sealed with a sliding ring seal 10 with respect to the shaft 3. The shaft 3 is supported via bearing elements 11.

Figure 2:
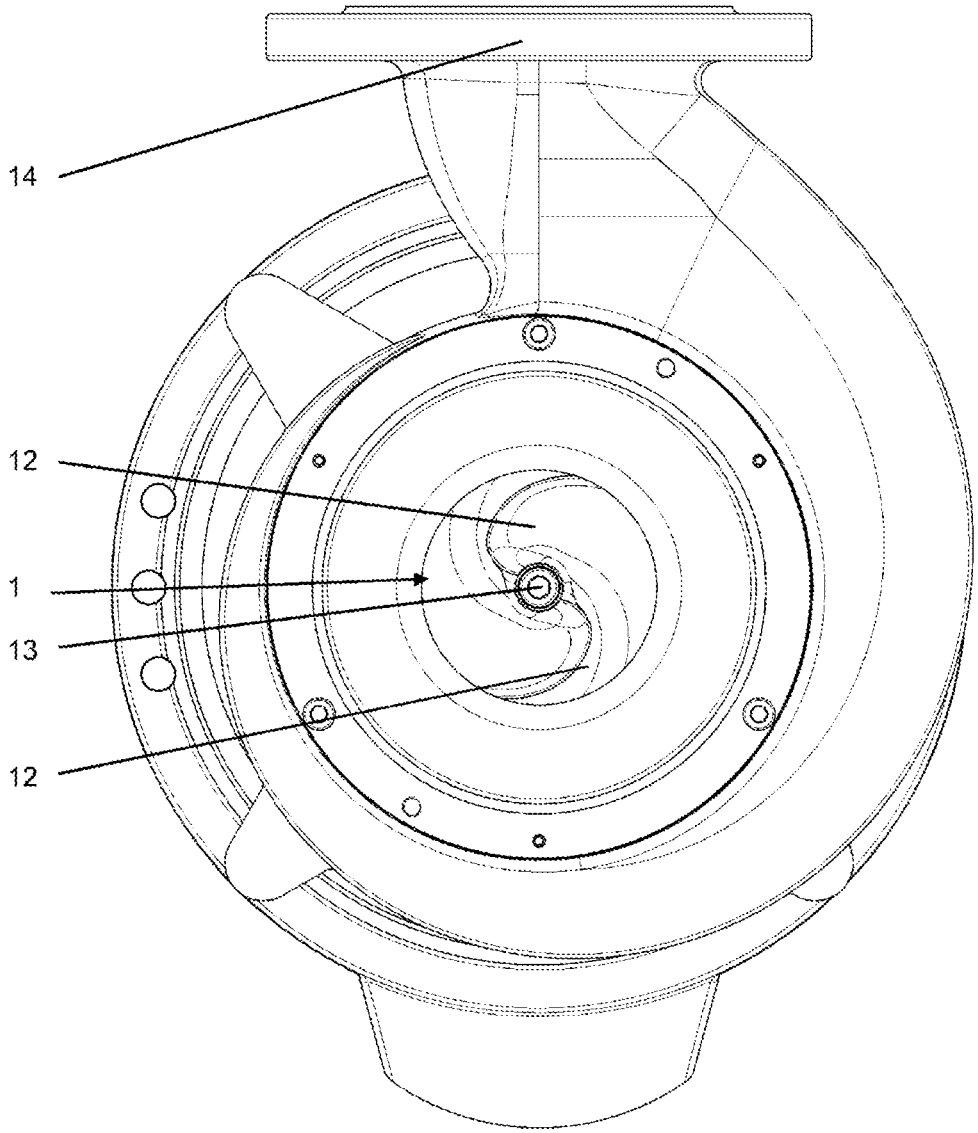
FIG. 2 is a view of the intake opening in accordance with an embodiment of the present invention.

FIG. 2 is a view of the centrifugal pump toward the intake opening 1. According to the illustration in FIG. 2, the impeller 2 comprises two blades 12. The impeller 2 has at the center thereof a hub 13 and is connected via a fixing means via this hub 13 to the shaft 3.

The fluid leaves the centrifugal pump via a pressure connection piece 14.

Figure 3:
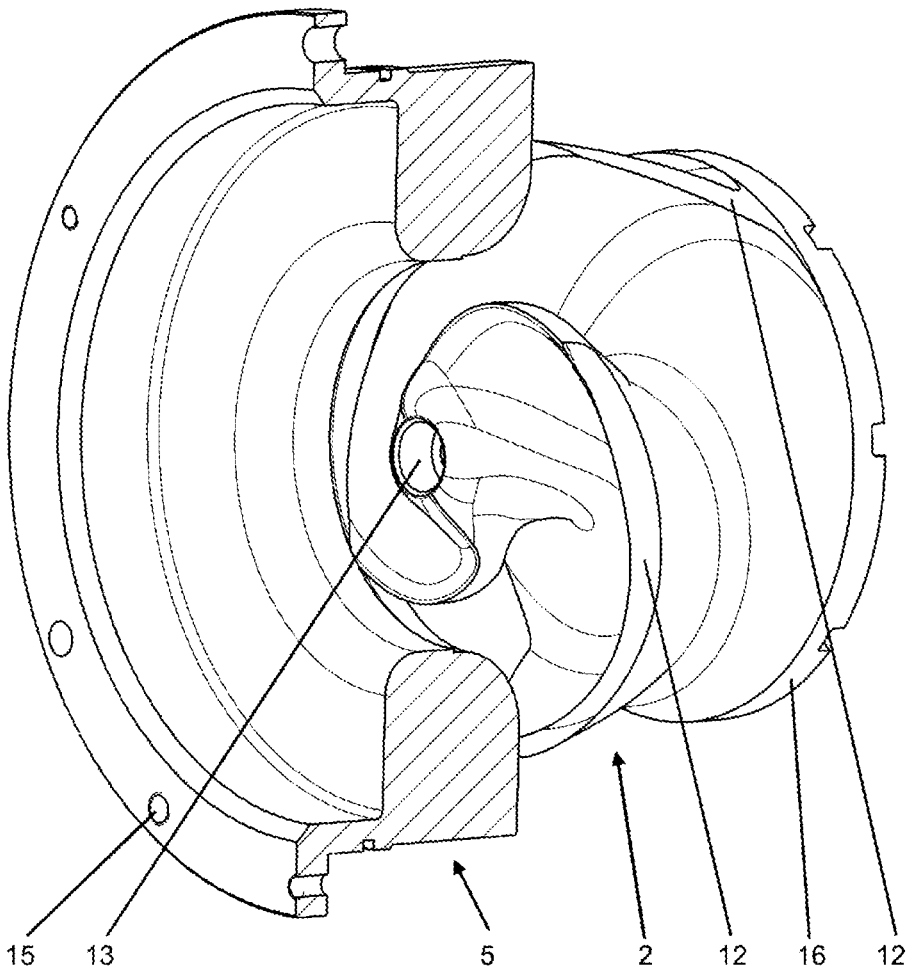
FIG. 3 is a perspective partial cross-section of the intake opening region in accordance with an embodiment of the present invention.

FIG. 3 is a perspective partial cross-section of the components which form the intake opening 1. The insert 5 is fixed to the pump housing 4. To this end, a plurality of holes 15 are provided in the insert 5. The insert 5 can be fixed via the holes 15 to the pump housing 4 by way of fixing means.

The impeller 2 rotates in a counter-clockwise direction when looking toward the illustration according to FIG. 3. The impeller 2 is provided with two blades 12 which are fixed to a rear shroud 16. In the embodiments, the two blades 12 and the rear shroud 16 are constructed in one piece. The blades 12 have a curved extent.

The medium which is displaced with solid admixtures flows axially through the intake opening 1 toward the impeller 2 and radially outward away from the impeller 2 so that the medium leaves the centrifugal pump through the pressure connection piece 14.

The blades 12 have a backwardly curved extent. All the blades 12 of the impeller 2 are constructed to be congruent with each other and have the same form. Each blade 12 extends from the hub 13 with a curvature radially outwardly. In the illustration according to FIG. 3, the two blades 12 are arranged to be offset by 180° relative to each other.

Figure 4:
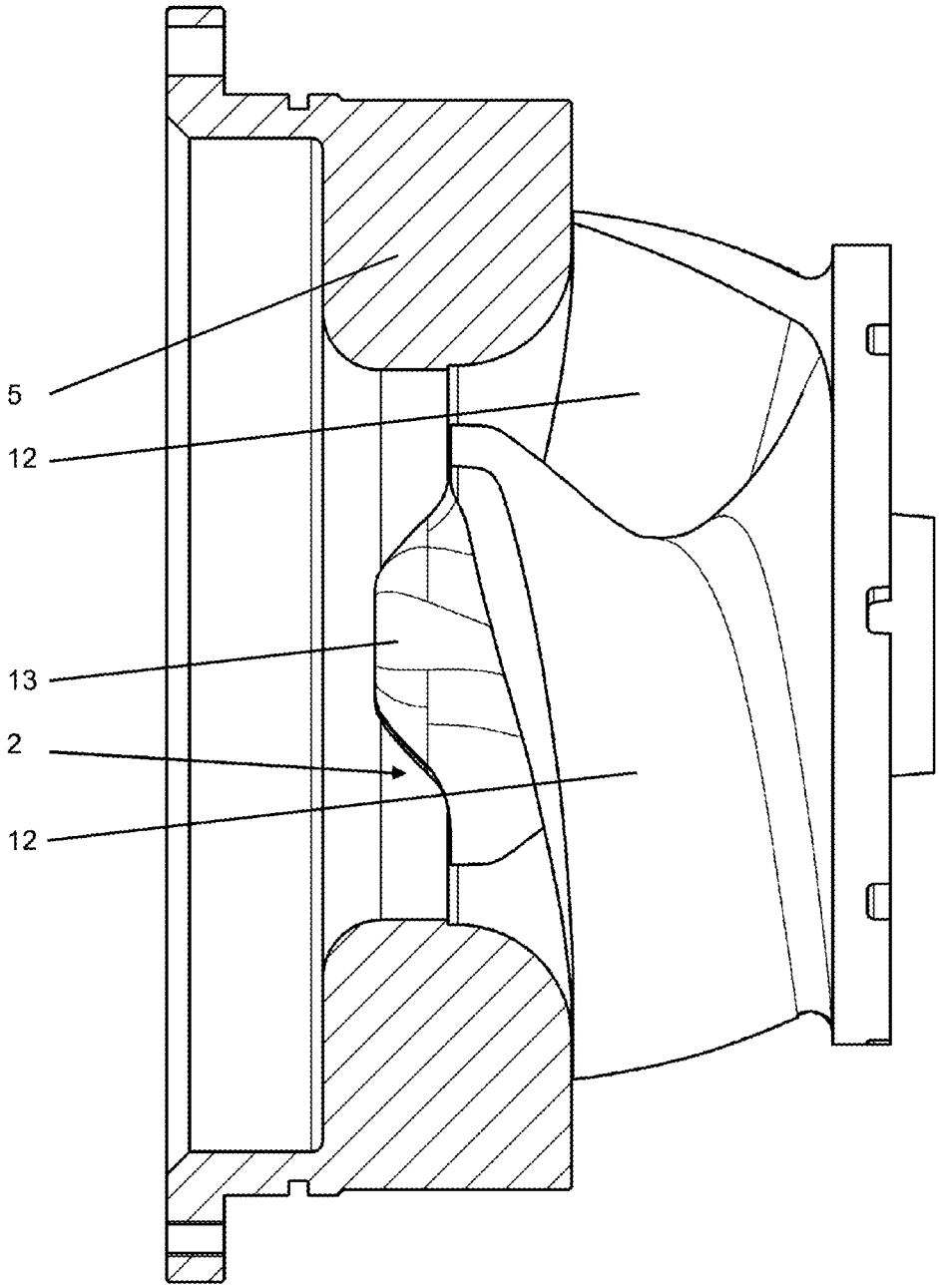
FIG. 4 is a section through the intake opening region in accordance with an embodiment of the present invention.

FIG. 4 is a cross-section through the intake opening region according to the illustration in FIG. 3. The insert 5 is a fixed component. The impeller 2 a rotating component. The blades 12 extend outward from the hub 13 radially with a backwardly curved extent.

Figure 5:
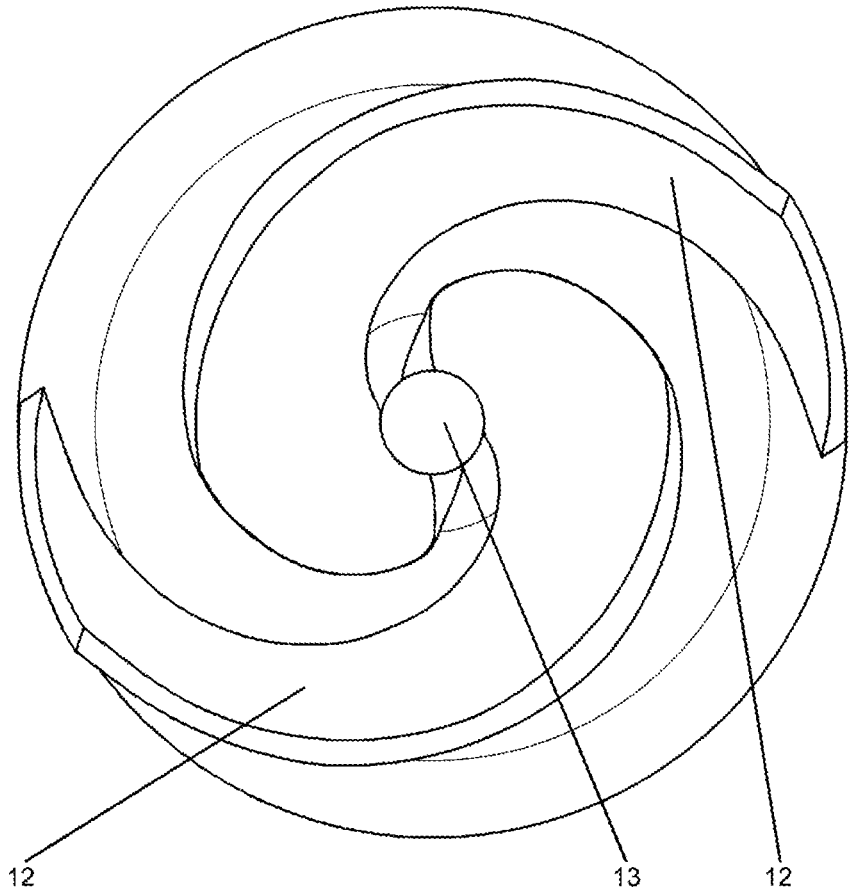
FIG. 5 is a plan view of the impeller in accordance with an embodiment of the present invention.

The illustration according to FIG. 5 also shows this again.

Figure 6:
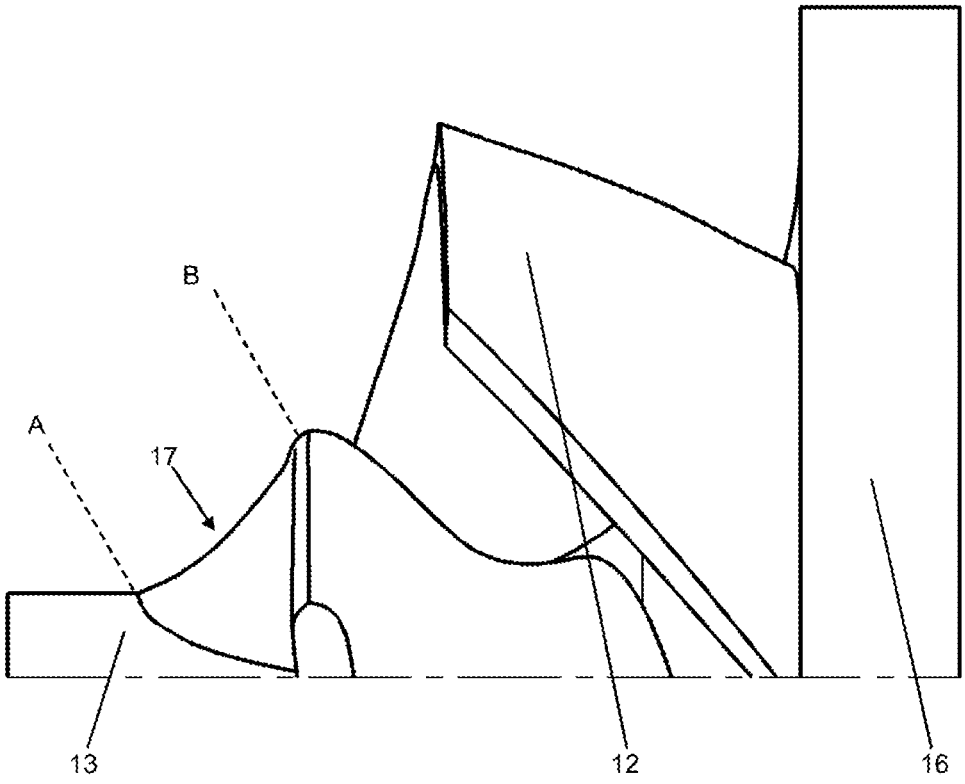
FIG. 6 is a perspective view of one half of the impeller in accordance with an embodiment of the present invention.

FIG. 6 shows one half of the impeller 2 as a perspective side view. The region of the hub 13 is illustrated here purely to show the constructive shape of the impeller of two cylindrical members. During the formation of the impeller 2, this cylindrical formation can be omitted.

An inlet edge 17 is applied to the hub 13 for each blade 12. The inlet edge 17 of each blade 12 extends between the two points A and B.

Figure 7:
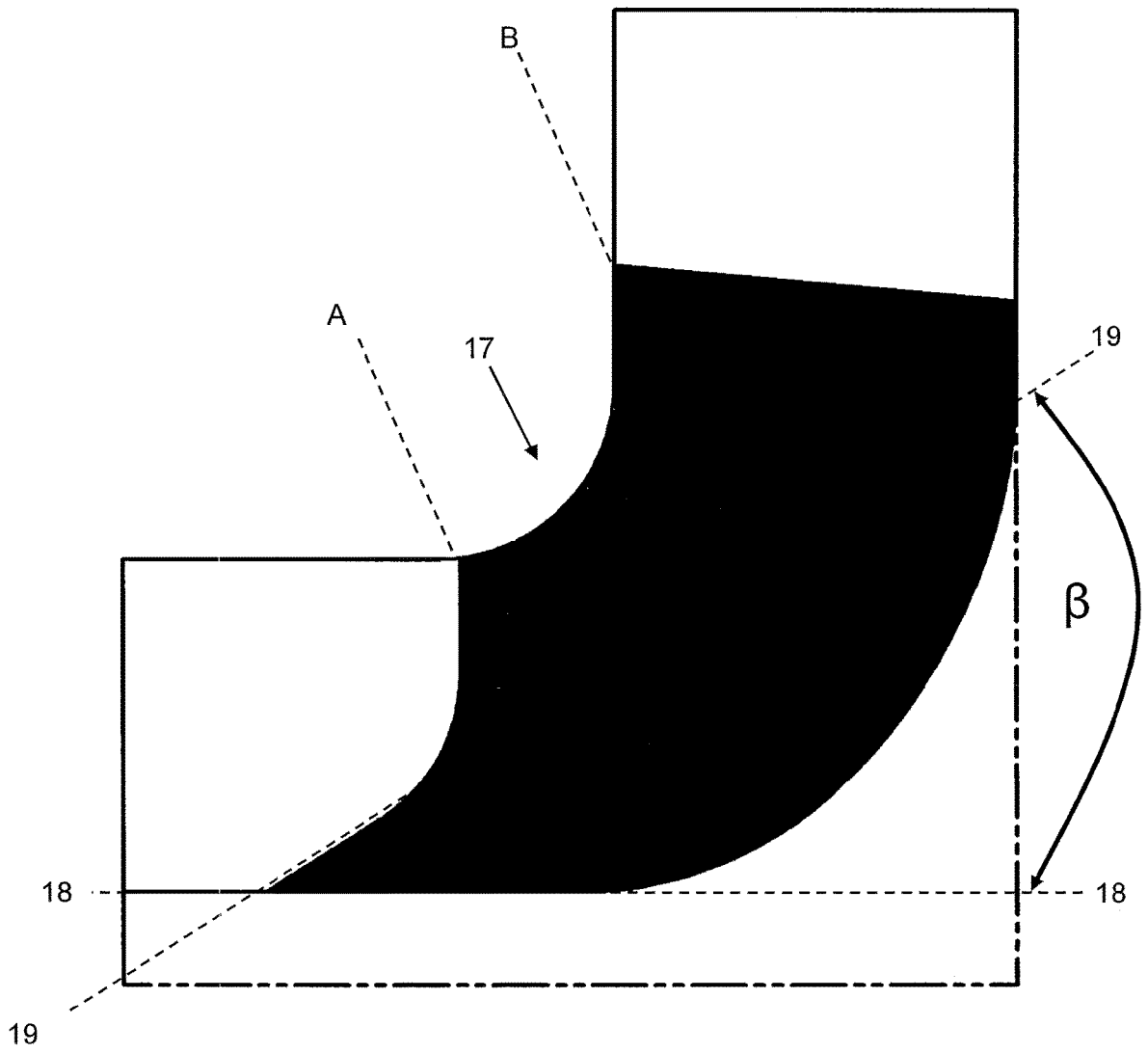
FIG. 7 is a schematic side view of the inlet region of the blade in accordance with an embodiment of the present invention, showing the definition of the angle β.

FIG. 7 shows the region of the inlet edge 17 in a state illustrated in black. The angle β results between the two auxiliary lines 18 and 19. The angle β is less than or equal to 45° according to the invention. In this case, β is an angle between an inlet edge 17 of a blade 12 and a meridional direction. In this case, β indicates the angle in the relative system. In the absolute system, the angle is designated α. In this case, α describes an angle between an inlet edge 17 of a blade 12 and a peripheral direction. Both angles α or β are less than or equal to 45° according to the invention.

Figure 8:
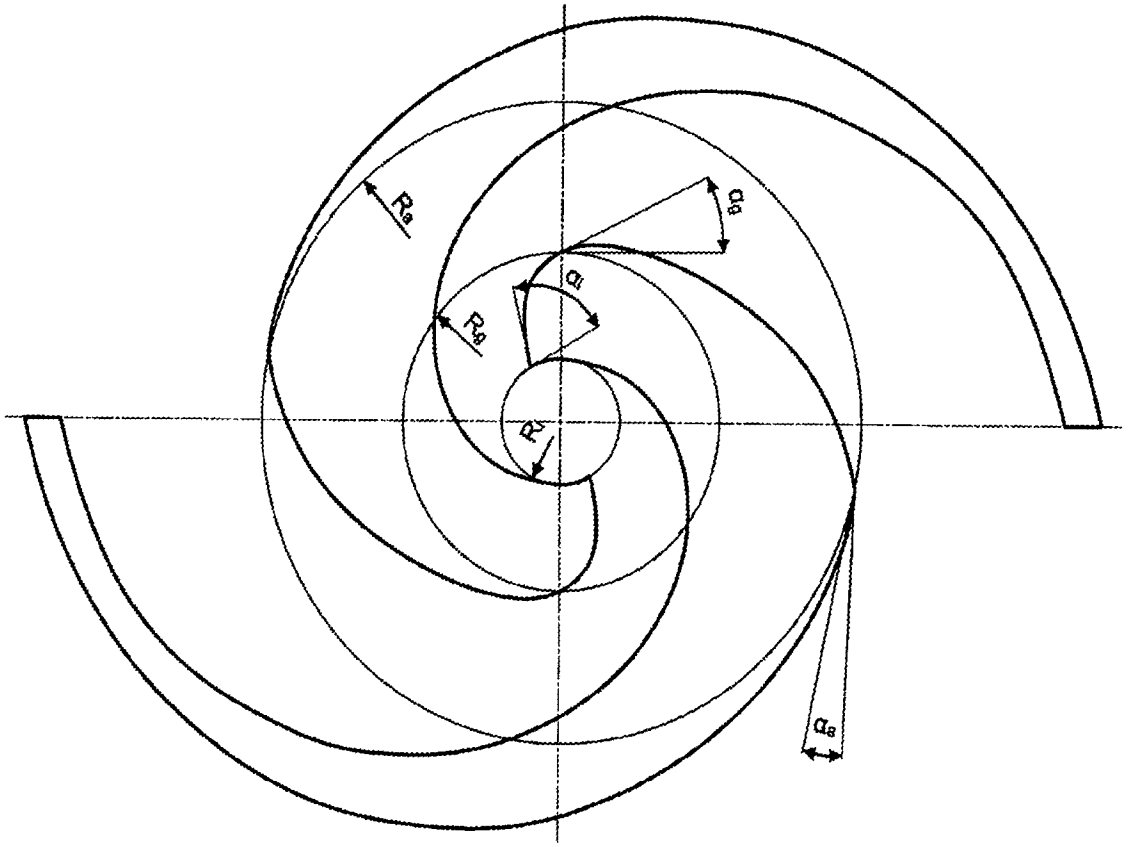
FIG. 8 is a plan view of an impeller in accordance with an embodiment of the present invention, showing a definition of the angle α.

FIG. 8 is a plan view of an impeller showing a definition of the angle α. The angle α is measured between the peripheral direction, that is to say, a circular direction, and a tangent at a point on the blade inlet edge in the radius considered. $\alpha_i$ is the angle at the inner radius $R_i$, $\alpha_g$ is the angle α at the limit radius $R_g$ and $\alpha_a$ is the angle at the outer radius $R_a$.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A centrifugal pump, comprising:

a pump casing; and an impeller, wherein the impeller includes at least one blade configured to convey solid-containing media, the at least one blade having an angle α between an inlet edge of the at least one blade and a peripheral direction and an angle β between the inlet edge of the at least one blade and a meridional direction, the impeller is a semi-open impeller without a cover over any portion of an inlet side of the impeller, a radially-innermost end of the at least one blade meets an axially-aligned hub portion of the impeller containing a rotation axis of the impeller at a region of the at least one blade axially farthest away from a rear shroud of the impeller, a dominant speed is the greater of a circumferential speed component of the impeller speed in the peripheral direction and an axial speed component of the impeller speed in the meridional direction, if the dominant speed is the circumferential speed, at least the angle α is less than 90°, if the dominant speed is the axial speed at least the angle β is less than 90°, in an inlet region of the impeller at which the solid-containing media enters the impeller, no solid-containing material shearing structure configured to shear solids from the at least one blade is arranged adjacent to the at least one blade, and the casing is axially adjacent to the at least one blade in at least a portion of a region in which the dominant speed is the circumferential speed.

2. The centrifugal pump as claimed in claim 1, wherein the impeller is a radial wheel.

3. The centrifugal pump of claim 1, wherein if the dominant speed is the circumferential speed at least the angle α is less than 45°, and if the dominant speed is the axial speed at least the angle β is less than 45°.

4. The centrifugal pump as claimed in claim 3, wherein the angle β is less than 45° in a radially inner region of the impeller.

5. The centrifugal pump as claimed in claim 4, wherein the angle α is less than or equal to 45° in a radially outer region of the impeller.

6. The centrifugal pump as claimed in claim 5, wherein the radially inner region and the radially outer region are defined by a limit radius $R_g$ of an axial impeller inlet, where $R_a \times \varphi$=the limit radius $R_g$ when $c_m$ equals u in the throughflow figure $\varphi = c_m/u$ at the limit radius $R_g$, with Ra being the outer radius of the blade, u being the peripheral speed of the blade, and φ being between 0.3 and 0.6.

7. The centrifugal pump The impeller as claimed in claim 5, wherein the at least one blade is precisely one blade.

8. The centrifugal pump as claimed in claim 5, wherein the at least one blade is precisely two blades.

9. The centrifugal pump as claimed in claim 3, wherein the angle α is less than or equal to 45° in a radially outer region of the impeller.

* * * * *